US006351899B1

(12) United States Patent
Slutzky

(10) Patent No.: US 6,351,899 B1
(45) Date of Patent: Mar. 5, 2002

(54) APPARATUS AND METHOD FOR SNOW GROOMING A TERRAIN PARK OR SKI AREA SLOPES

(76) Inventor: David Slutzky, P.O. Box 829, Hunter, NY (US) 12442

( * ) Notice: Subject to any disclaimer, the term of this patent is extended or adjusted under 35 U.S.C. 154(b) by 0 days.

(21) Appl. No.: 09/572,143

(22) Filed: May 17, 2000

Related U.S. Application Data

(60) Provisional application No. 60/134,726, filed on May 18, 1999.

(51) Int. Cl.[7] ..... E01H 4/00

(52) U.S. Cl. ..... 37/223; 37/234; 37/241; 180/9.52

(58) Field of Search ..... 37/219, 223, 234, 37/236, 241, 248, 197, 222; 180/9.32, 9.44, 9.46, 9.52, 41

(56) References Cited

U.S. PATENT DOCUMENTS 3,095,938 A * 7/1963 Bertelson
3,652,106 A * 3/1972 Waterman
3,888,544 A * 6/1975 Bennett
3,970,405 A * 7/1976 Swisher, Jr. et al.
4,029,165 A * 6/1977 Miller et al. ..... 180/9.46
4,523,398 A * 6/1985 Scheibel et al.
4,966,242 A * 10/1990 Baillargeon ..... 180/9.44
5,067,264 A * 11/1991 Beeley
5,078,216 A * 1/1992 Dick
5,809,671 A * 9/1998 Sinykin ..... 37/219
6,085,445 A * 11/2000 Kanzler ..... 37/222
6,176,334 B1 * 1/2001 Lorenzen ..... 180/9.48

* cited by examiner

*Primary Examiner*—H. Shackleford
(74) *Attorney, Agent, or Firm*—Chadbourne & Parke LLP

(57) ABSTRACT

A vehicle for grooming a terrain of snow having a plurality of hydraulically driven rotary tiller units independently mounted for axial lateral movement relative to the plane of the rectangular main frame of the vehicle. Bogey track units support the vehicle and allow for movement.

19 Claims, 7 Drawing Sheets

APPARATUS AND METHOD FOR SNOW GROOMING A TERRAIN PARK OR SKI AREA SLOPES

REFERENCE TO RELATED APPLICATIONS

This application is a continuation of provisional application Ser. No. 60/134,726, filed May 18, 1999, and still pending.

BACKGROUND OF THE INVENTION

The present invention relates to a snow grooming machine with completely independent, non-coupled tiller units. The present invention is a distinct improvement over the existing state of the art in terrain grooming machines, such as described in U.S. Pat. No. 5,067,264 and others, in which the tiller units are flexibly coupled together endwise thereby limiting the angularity with respect to each other, which in turn limits the capability of the machine to finely groom the moguls and other shapes required in most terrain parks.

Further, as indicated in the prior art shown in U.S. Pat. No. 5,067,264, the flex-jointed tiller units are unable to groom the peaks of the moguls encountered because of their limited angularity, nor can they groom the valleys in between for the same reason. The present invention has solved this problem by making the tiller units completely independent of each other, thereby permitting the individual units to angulate to the actual shape of the moguls and properly groom the peaks as well as reach fully into the valley between them. While the aforementioned patent states that the tiller units can flex, or angulate as much as 28 degrees, it is well known that the actual shapes of the moguls may be as severe as 45 degrees, therefore, when they are tilled with that machine, it actually cuts off their tops and fills in their valleys, thus diminishing the value of the terrain to the skier.

SUMMARY OF THE INVENTION

The main object of the present invention described herein is the ability to groom terrain surfaces using hydraulically powered, fully independent, non-coupled tiller units. The invention can actually create new moguls from a smooth surface to a predictable severity, size and shape as may be desired by skiers or snow-boarders. This is an improvement of the present invention over the prior art as described in U.S. Pat. No. 5,067,264 because of its flex-coupled tiller units and resultant limited angularity and flexibility, the machine of this patent can merely groom relatively smooth surfaces.

Another improvement of the present invention over the prior art cited above is that this machine may have several rows of independent tiller units thereby permitting it to be programmed to completely groom a terrain park in a predictable and desirable shape. Additional objects of the present invention are to provide increased efficiency in grooming operations by allowing for the modular addition of tiller units to increase the width of snow to be tilled by the machine, and by powering the tiller units independently of each other and thereby eliminating power loss through "flex-joints".

The indicated prior art in U.S. Pat. No. 5,067,264 shows the bogey track units to be immovably fixed to the main frame of the machine permitting only forward and backward motion on relatively even surfaces, thereby limiting the severity of the terrain it can function on. The present invention improves on this by mounting the bogey track units on each corner of the main frame in an angularly adjustable manner with the capability of extending and/or retracting them as required. This permits the grooming machine of the present invention to conform its action to virtually any level of severity encountered on a mountain or terrain park slope. Further objects of the present invention are to provide the ability to groom "state of the art" terrain parks as are popular in the skiing industry, and to provide the ability to groom what is referred to by snow-boarders as "half-pipes", as well as the ability to add interest into out-of-shape terrain for skiers and snow-boarders.

Since it is necessary to move the machines from place to place in a terrain park, which is made up of many different slopes in different areas, the mobility of the units is usually limited by the width of the "cat-tracks" or connecting trails from one slope to another. The prior art shown in U.S. Pat. No. 5,067,264 limits the width of the described machine, because its bogey track units limit it to straight traveling with its width presented to the direction of travel therefore requiring it to be no wider than the relatively narrow "cat-track" mountain trails.

It is a further object of the present invention, as an improvement over the prior art, to mount the bogey track units on the corners of the main frame in a manner permitting them to be swung, or rotated around the corner of the frame and aligning their travel with the narrow, or end side of the main frame presented to the direction of travel, thereby improving the mobility of the present invention over the narrow "cat-track" slope connecting trails.

Still further objects of the present invention are to provide a snow grooming machine which is independently supported by design of its main frame thereby precluding the need to drag it as is shown in the presently available equipment as seen in U.S. Pat. No. 5,067,264. Moreover, the apparatus of the present invention can be operated under its own power, or towed by a tractor, either with the bogey tracks attached, or with the bogey tracks replaced by sled runners.

These and other advantages of the present invention are achieved by the vehicle of the present invention. The present invention comprises the main frame, the tiller units, the bogey tracks, power units that drive hydraulic pumps to transmit the required power to the individual elements cited, an operators cabin, computer controls for the equipment cited, and the necessary computer programs to operate the whole, under the control of an operator. It is a further object of the present invention is to provide the ability to adjustably position a visor to limit the glare of the sun or the snow falling on the operators' viewing windows.

Through the use of pre-programming of the control computers, a complete terrain park may be groomed and shaped to a form desired for its intended use.

Although the preferred embodiment of the present invention is as a self-propelled unit, having its own motive power, it may also be designed to be pulled by a tractor as well. It should also be noted that, as a tractor pulled unit, the bogey track units may be replaced by sled runners so desired.

According to a preferred embodiment of the present invention, snow grooming vehicle having multiple hydraulic tiller units mounted to a rectangular main frame is driven by hydraulically powered bogey track units at each corner. The bogey track units are mounted to the main frame by hydraulic cylinders in a universally pivotal manner so they may be extended or withdrawn or angulated as required by the terrain which is being groomed. A plurality of tiller units each having a hydraulically driven rotary tiller drum is mounted under the main frame by a hydraulic cylinder at each end. The hydraulic cylinders are pivotally mounted to the main frame so they may each move the tiller drum both laterally and longitudinally by appropriately connected hydraulic cylinders in respect to the main frame. The tillers attached to the hydraulic cylinders may be extended or withdrawn, each end independently of the other, as well as being moved laterally or longitudinally, as required. An additional tiller unit is preferably mounted in a retractable fashion on each side of the main frame in a manner to be deployed axially vertical relative to the plane of the main frame. The purpose of these tiller units is to groom the vertical portion of the lip of the snow-boarder's "half-pipe" run. The positioning of these tiller units will be accomplished with appropriately positioned hydraulic cylinders. Preferably, these tiller units may be mounted in a manner to be able to retract to an axially horizontal position.

The multiple, hydraulically driven tillers are mounted axially lateral in two or three units or as many as is practical and desired for the size main frame desired. Further, there may be more than one row of the axial, laterally mounted tiller units mounted under the main frame, thereby having a second or third row in tandem.

It is important to note that the individual tiller units are not connected to each other endwise, thereby enabling them to move in a completely independent manner to each other so the machine may not only groom mogully, uneven terrain, but also permit the shaping of even smooth terrain into any form desired such as moguls, or the "half-pipe" configuration which is used for snow boarding.

By virtue of this fully independent tiller mounting system, the machine can groom what is now referred to as "terrain parks" in a manner that cannot be done by the existing snow tillers presently available.

The presently available tiller machines for grooming snow do not have the angular independence required to fully groom the terrain that skiers and snow boarders want today. The present grooming machines, such as the Flex Tiller, are limited to only grooming slightly uneven terrain and cannot conform to the mogully surfaces encountered on most slopes because their tiller units are linked endwise, thereby severely limiting them from achieving the angularity required to fulfill the requirements of complete grooming.

With the independent overhead grooming ability provided by the present invention, moguls can now be groomed or made as never before possible with any present rear-mounted tillers currently on the market. Because of the independent overhead position of the tillers, moguls in any kind of pattern, from small and easy to large and more difficult, can be created. The present invention has the ability to carve moguls in a connected series creating a mogul terrain for the satisfaction of beginning to expert skiers.

These and other features of the present invention will be more apparent from the following detailed description read with the attached drawings, wherein:

DETAILED DESCRIPTION OF THE INVENTION

Figure 1C:
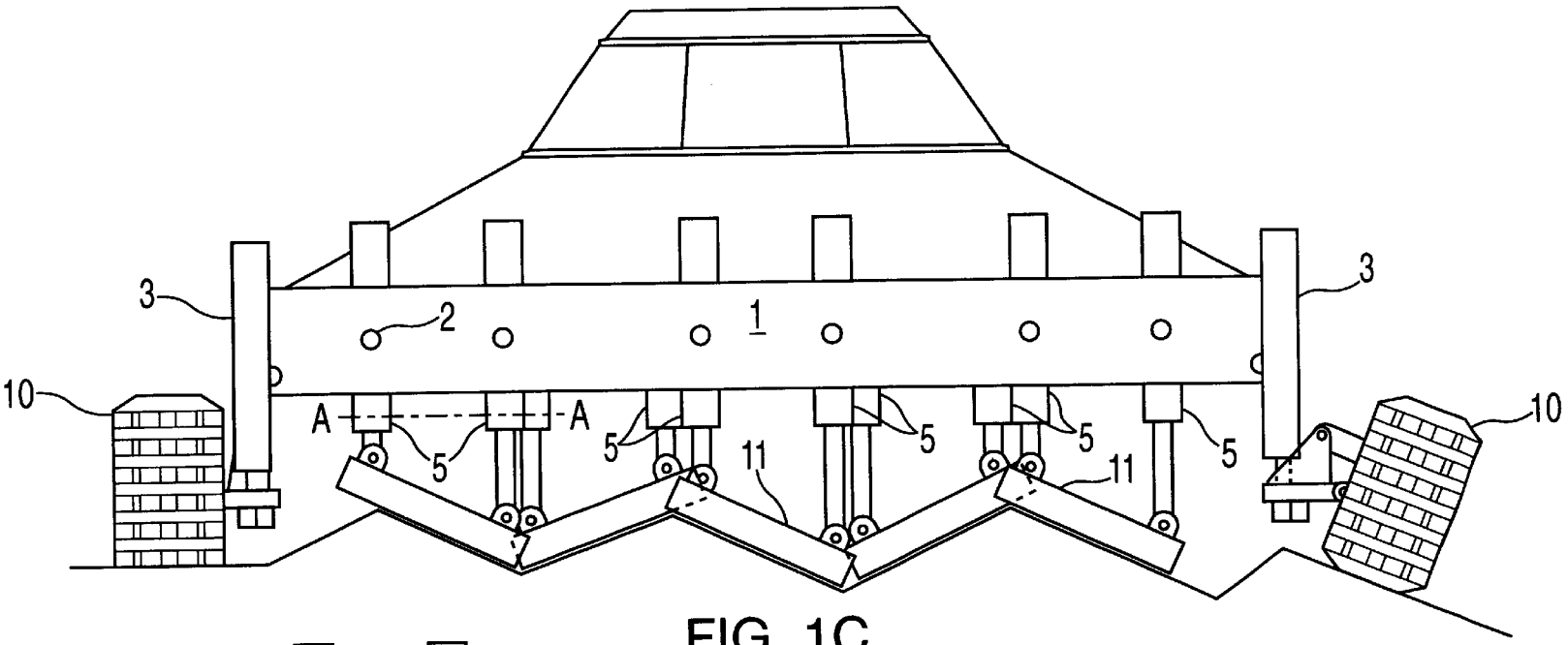
FIG. 1 shows a head on, schematic view of the present invention with its various components attached thereto.
Figure 1B:
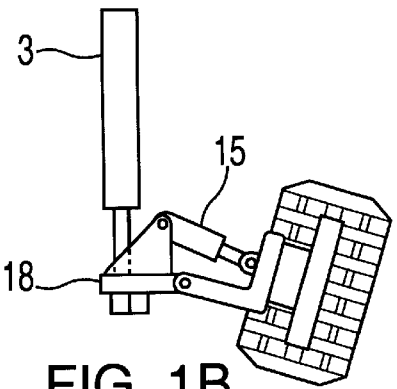
Figure 1A:
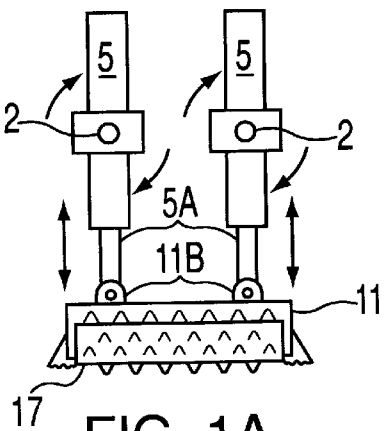

Referring now to FIGS. 1–6, in a preferred embodiment of the present invention, the result of the action of which is the clear definition of the mogul (mounds of snow) pattern behind it, as versus the less defined shape of the terrain ahead, awaiting grooming. FIG. 1 shows a head on, schematic view of the present invention. The main frame (1) serves as the back-bone of the vehicle to which all the components are mounted. The tiller units (Detail A) are mounted to the main frame by hydraulic cylinders (5) which are pivotally secured by their mounting pins (2). The rotating, toothed elongated cylinder shaped tiller (17) is mounted on the tiller frame (11) which is secured to the connecting rod end of the hydraulic cylinder by shackle (11B). The drawing shows the tiller units angulated to one another presenting a saw-tooth configuration. This is accomplished by extending or retracting the connecting rods (5A) of the cylinders (5) as required, and allowing them to pivot on pins (2) as required. The tillers (17) are powered by an integral hydraulic motor (not shown) which is driven by hydraulic pressure, through a flexible hydraulic line from the main power source (not shown) located on the main frame (1).

The bogey track units (Detail B), which are driven by hydraulic motors energized through hydraulic lines from the main diesel powered pumps, are mounted on each corner of the main frame (1). This unit comprises the track bogey (10), angulating hydraulic cylinder (15), bogey yoke (18), and mounting hydraulic cylinder (3).

Mounting cylinder (3) is mounted to the main frame in an axially rotatable manner to facilitate the moving of the bogey units around the corner of the main frame (1) to permit the change of direction of travel of the machine.

The main power source is a hydraulic pump sized to produce the volume and pressure necessary to power the tillers, the bogey tracks and all attendant hydraulic cylinders. The preferred source of power for the hydraulic pump is a diesel powered motor, however, electric or diesel-electric sources may also be used.

Figure 3:
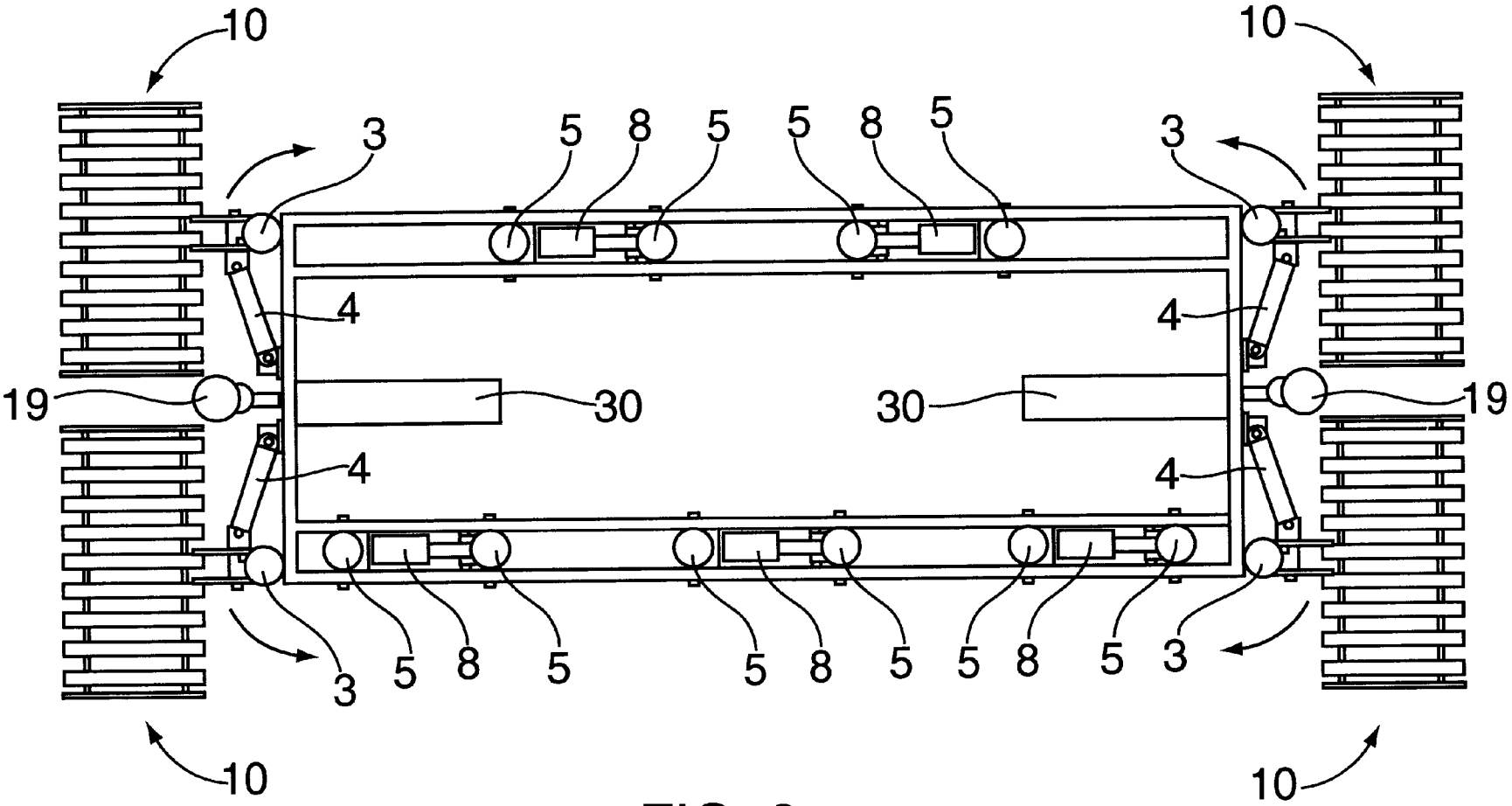
FIG. 3 shows a top, cut-section, view of the present invention and its various attached components.
Figure 4:
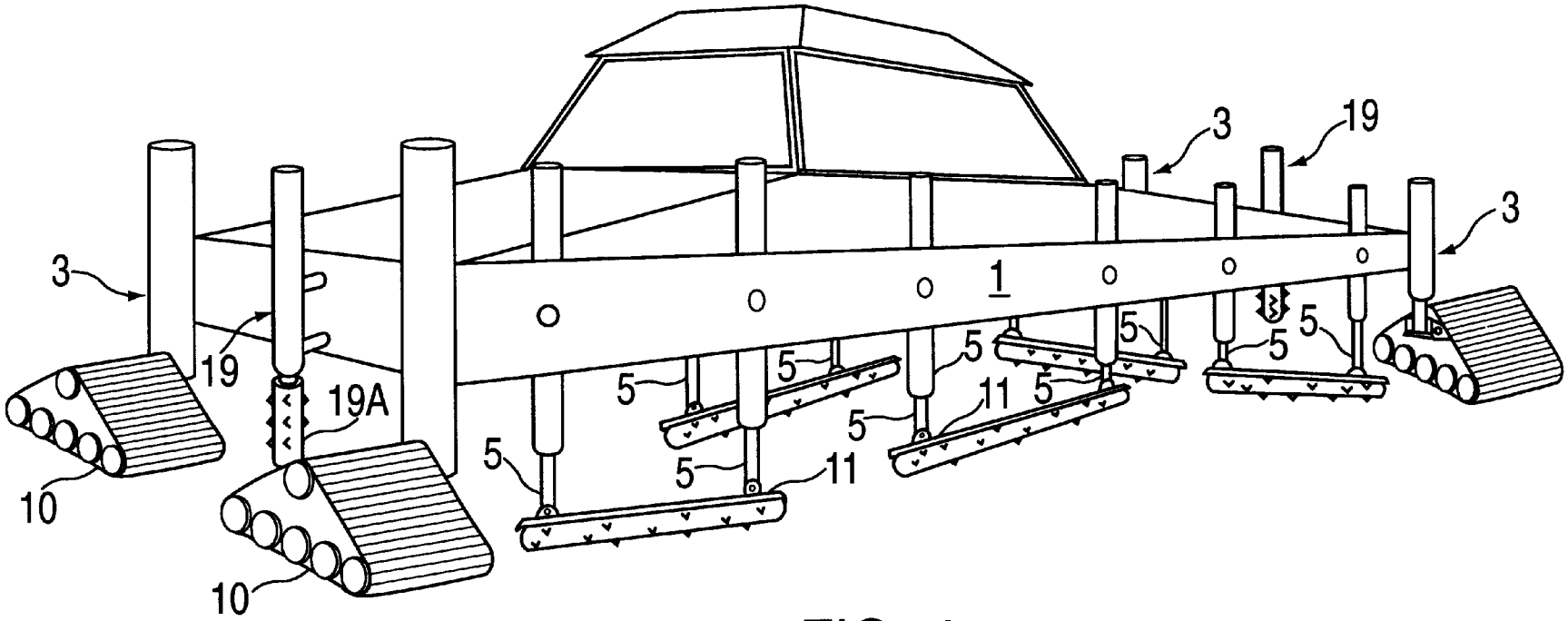
FIG. 4 is a perspective view of the present invention.

Two rows of tiller units may be seen under the main frame in FIGS. 3 and 4. As particularly shown in FIG. 6, the hydraulic cylinders (5) of the tiller units operate in an independent up and down motion allowing the tillers to be independently positioned through a range of angles. In addition, lateral side to side motion of the tillers, as well as fixation of lateral movement, is provided by hydraulic cylinders (8).

Hydraulic cylinders (8), which are pivotally secured to the main frame and hydraulic cylinders (5) by their mounting pins provide lateral movement to the tillers by extension and contraction. Cylinders (8) allow cylinders (5) to position the tillers in a range of positions to create desired shapes and forms by giving them angular direction, and by holding them in a particular fixed position.

Figure 2:
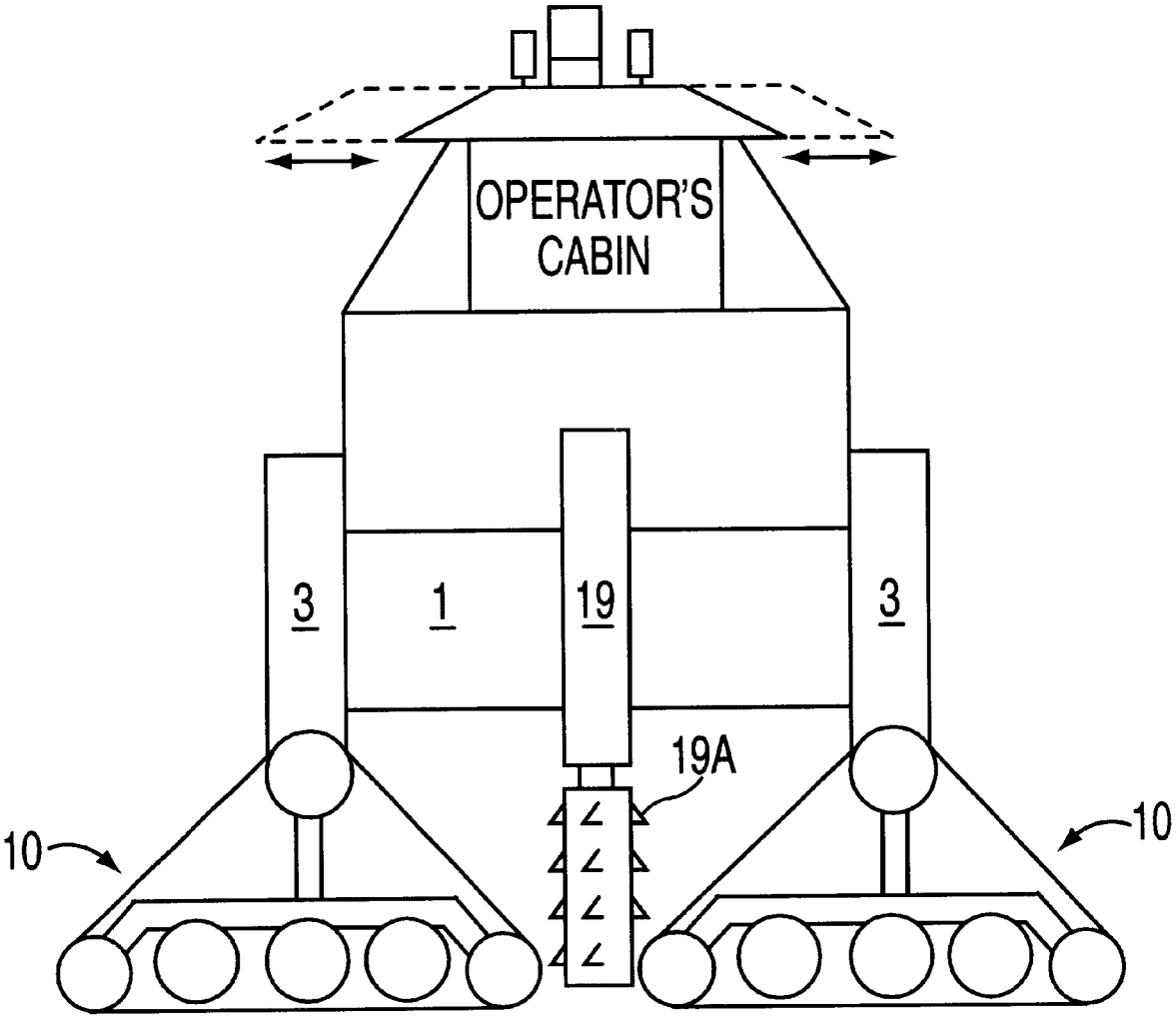
FIG. 2 shows a side view of the grooming machine.
Figure 5:
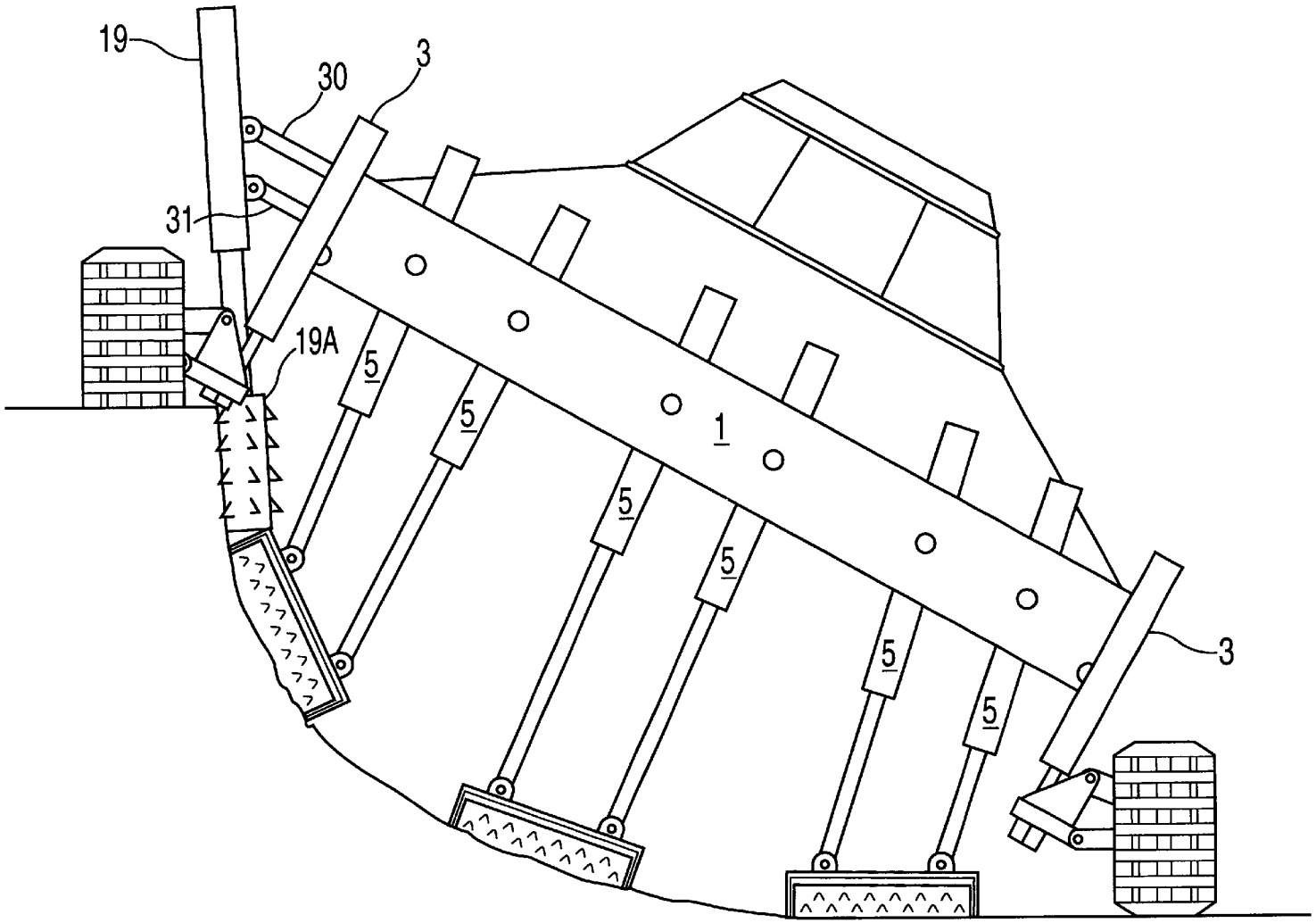
FIG. 5 is a front view of the invention depicted in uneven terrain.
Figure 6:
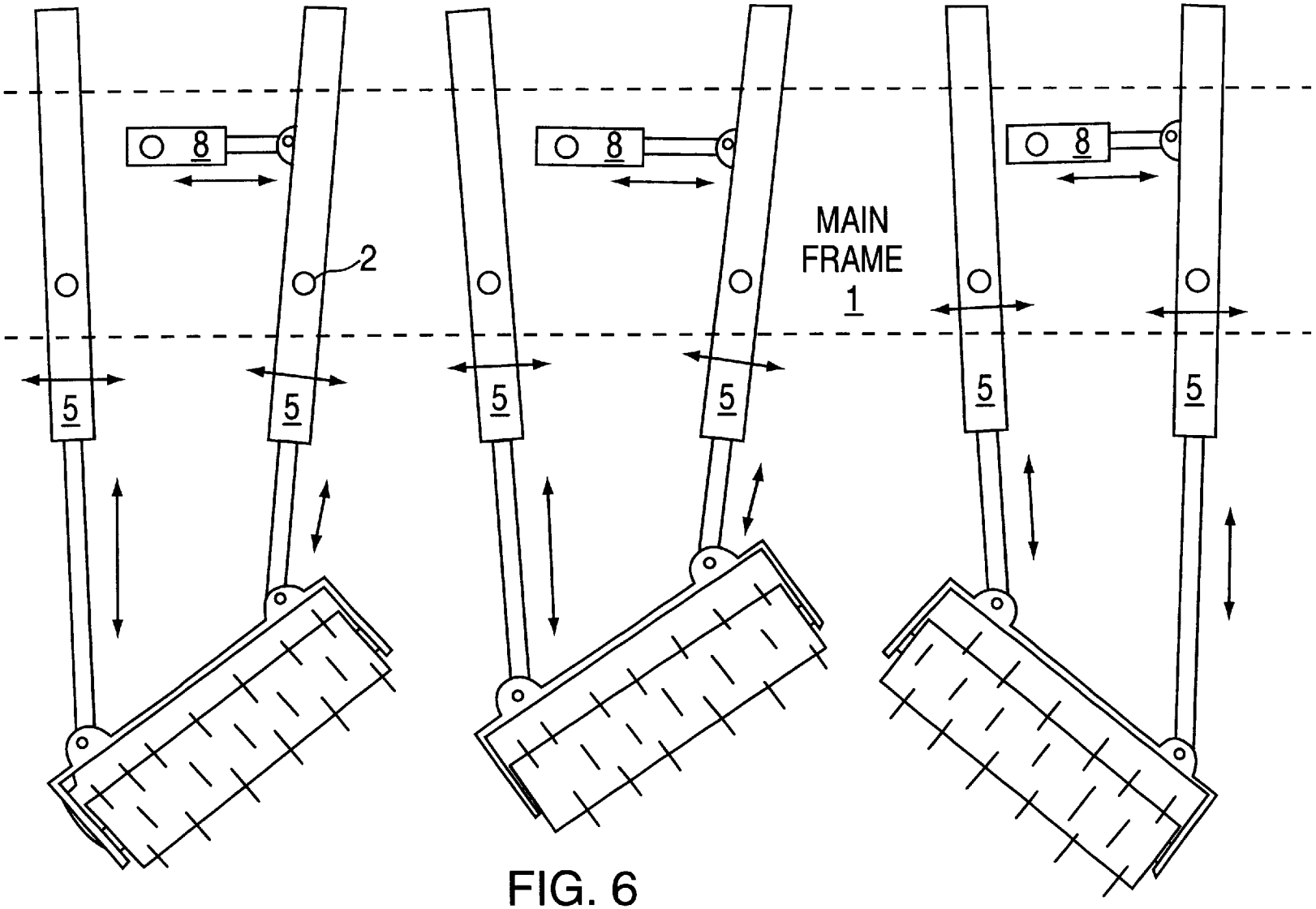
FIG. 6 is a detailed view of the independent tiller units showing the variable positioning ability of each.
Figure 7:
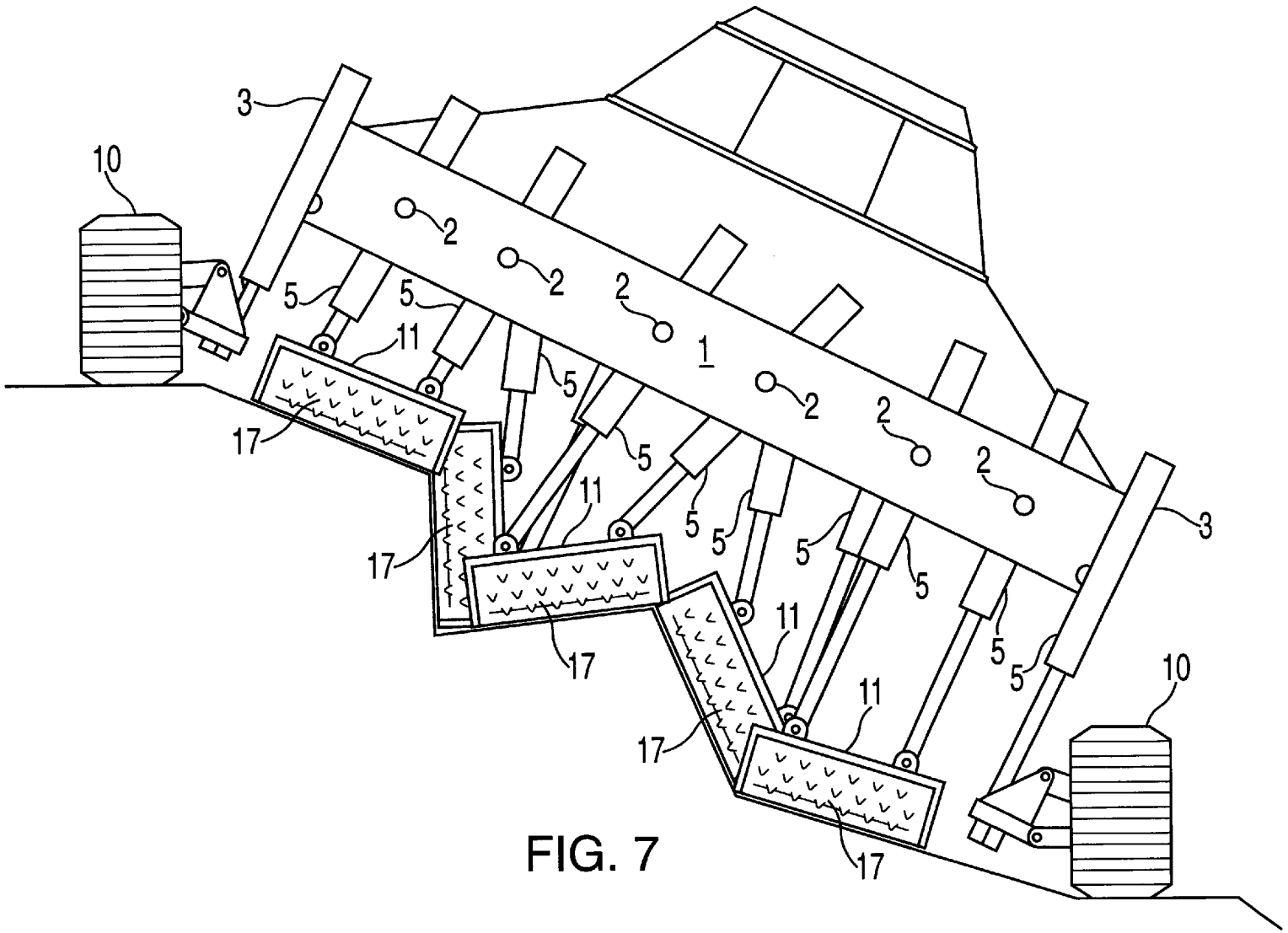
FIG. 7 is a front view of another embodiment of the present invention.

Vertically deployed tillers (19A) can be seen on the side of the machine as depicted in FIG. 2. Cylinders (19) are supported from the main frame (1) by two pivotally mounted hydraulic cylinders (30, 31) as shown in FIG. 5. FIG. 2 shows cylinder (19), with vertical tiller (19A), in the retracted position. As in FIG. 5, cylinders (30, 31) allow cylinders (19) to stay in a vertical position when the machine is on uneven terrain. Cylinders (30 and 31) also allow cylinders (19) to remain in a float pattern allowing vertical tiller unit (19A) on cylinder (19) to groom uneven side slopes and forms. By having cylinder (19) movably mounted to main frame (1) by cylinders (30, 31), the invention is able to groom "half pipes" and other terrain park shapes that require a vertical or near vertical finish as shown in FIG. 5. The tiller unit (19A) on cylinder (19) is mounted in a manner to be able to retract and extend while being rotated by hydraulic means.

Cylinders (5) on main frame (1), FIGS. 1 and 4, can be programmed to operate independently of each other, and also in a sequence to produce certain patterns or forms such as moguls. The size and shape of the forms created, and accordingly the level of difficulty in skiing the shapes and forms, can be designed and adjusted as desired.

What is claimed is:

1. A vehicle for grooming snow, comprising:

a main frame, defining a plane in relation to a terrain upon which said vehicle moves;

a plurality of hydraulically driven, non-coupled rotary tiller units, at least one of said tiller units independently overhead-mounted on said main frame for pivotal movement relative to an axis that is at an angle to said plane defined by said main frame; and a plurality of bogey track units upon which said vehicle moves.

2. The apparatus according to claim 1, wherein said main frame is rectangular in shape.

3. The apparatus according to claim 1, wherein at least one of said plurality of hydraulically driven, non-coupled rotary tiller units is connected to said main frame by at least one hydraulic cylinder mounted in an angularly adjustable manner relative to said plane of said main frame, the angular position of said cylinder defining the axis for pivotal movement of said rotary tiller unit.

4. The apparatus according to claim 2, wherein at least one of said plurality of bogey track unit is mounted to a corner of said main frame, in an angularly adjustable manner relative to said main frame.

5. The apparatus according to claim 4, wherein a second bogey track unit is mounted to an opposite corner of said main frame in an angularly adjustable manner relative to said main frame, the relative angular position of said second bogey track unit being independent of the angular position of said at least one bogey track unit on the opposite corner.

6. The apparatus according to claim 1, wherein at least one of said plurality of bogey track units is hydraulically powered.

7. The apparatus according to claim 1, wherein said at least one of said plurality of bogey track units is angularly adjusted by at least one hydraulically controlled cylinder.

8. The apparatus according to claim 1, wherein at least one of said plurality of bogey track units is universally pivotable by at least one hydraulically controlled cylinder around an axis that is at an angle to said plane of said main frame.

9. The apparatus according to claim 8, wherein said axis is substantially perpendicular to said plane of said main frame.

10. The apparatus according to claim 8, wherein said bogey track unit pivots around a nearest corner of said main frame into an alignment with other bogey track units to move said vehicle with a narrow side of said main frame facing the direction of travel.

11. The apparatus according to claim 1, further comprising at least one powered hydraulic power unit for supplying hydraulic power.

12. The apparatus according to claim 1, further comprising at least one operator cabin with hydraulic controls mounted on said main frame.

13. A method of creating a groomed terrain of snow, comprising the steps of:

moving a grooming vehicle over a terrain;

rotating a plurality of non-coupled rotary tiller units independently mounted on a main frame of said vehicle in a pivotal movement relative to an axis that is at an angle to a plane defined by said main frame; and independently adjusting and positioning said grooming tillers relative to said main frame to create a predetermined terrain contour.

14. The method of claim 13, wherein said axis is substantially perpendicular to said plane defined by said main frame.

15. A vehicle for grooming snow, comprising:

a rectangular main frame, defining a plane in relation to a terrain upon which said vehicle moves;

a plurality of hydraulically driven, non-coupled rotary tiller units, at least one of said tiller units independently overhead-mounted on said main frame for pivotal movement relative to an axis that is at an angle to said plane defined by said main frame; and a plurality of bogey track units upon which said vehicle moves, wherein at least one of said plurality of bogey track unit is mounted to a corner of said main frame in an angularly adjustable manner relative to said main frame and a second bogey track unit is mounted to an opposite corner of said main frame in an angularly adjustable manner relative to said main frame, the relative angular position of said second bogey track unit being independent of the angular position of said at least one bogey track unit on the opposite corner;

wherein at least one of said plurality of bogey track units pivots around a nearest corner of said main frame into an alignment that allows to move said vehicle with a narrow side of said main frame facing the direction of travel.

16. The apparatus according to claim 15, wherein at least one of said plurality of hydraulically driven, non-coupled rotary tiller units is connected to said main frame by at least one hydraulic cylinder mounted in an angularly adjustable manner relative to said plane of said main frame, the angular position of said cylinder defining the axis for pivotal movement of said rotary tiller unit.

17. The apparatus according to claim 15, wherein the angular adjustment and pivotal movement of at least one of said plurality of bogey track units is provided by at least one hydraulically controlled cylinder.

18. The apparatus according to claim 17, further comprising at least one powered hydraulic power unit for supplying hydraulic power.

19. The apparatus according to claim 18, further comprising at least one operator cabin with hydraulic controls mounted on said main frame.

* * * * *